US008007099B2

(12) United States Patent
Domoto et al.

(10) Patent No.: US 8,007,099 B2
(45) Date of Patent: Aug. 30, 2011

(54) PRINTER WITH RELEASE AGENT METERING ON DRUM

(75) Inventors: Gerald A. Domoto, Braircliff Manor, NY (US); Jason O'Neil, Rochester, NY (US); Paul McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 32 days.

(21) Appl. No.: 12/401,362

(22) Filed: Mar. 10, 2009

(65) Prior Publication Data

US 2010/0231674 A1 Sep. 16, 2010

(51) Int. Cl.
*B41J 2/01* (2006.01)

(52) U.S. Cl. ..... 347/103; 347/88; 347/99

(58) Field of Classification Search ..... 347/88, 347/99, 103

See application file for complete search history.

(56) References Cited

U.S. PATENT DOCUMENTS 4,041,864 A * 8/1977 Dahlgren et al. ..... 101/350.4
5,835,833 A * 11/1998 Dalal et al. ..... 399/325
6,176,180 B1 * 1/2001 Taylor et al. ..... 101/148
2001/0055052 A1 * 12/2001 Mueller et al. ..... 347/88
2007/0182800 A1 * 8/2007 Fioravanti et al. ..... 347/103

* cited by examiner

*Primary Examiner* — Matthew Luu

*Assistant Examiner* — Rut Patel

(74) *Attorney, Agent, or Firm* — Maginot, Moore & Beck LLP

(57) ABSTRACT

A method and apparatus for metering release agent on an imaging member includes applying a release agent to a rotating imaging member at an application location and then controlling a thickness of the release agent on the imaging member with a rotating metering roll. In at least one embodiment, the method for metering a release agent includes rotating the metering roll as a counter-roll to an imaging drum such that the metering roll moves in an opposite direction from the imaging drum at a nip between the metering roll and the imaging drum. The metering roll may include an elastomer provided over the substantial portion of its outer surface which contacts the imaging drum. The metering roll may also be forcibly biased against the imaging drum. At least one wiper blade may be provided in contact with the metering roll to wipe excess release agent from the metering roll.

19 Claims, 6 Drawing Sheets

PRINTER WITH RELEASE AGENT METERING ON DRUM

TECHNICAL FIELD

This disclosure relates generally to printers having a rotatable drum and, more particularly, to the components and methods for metering release agent on a rotatable drum in a printer.

BACKGROUND

Solid ink or phase change ink printers conventionally receive ink in a solid form, either as pellets or as ink sticks. The solid ink pellets or ink sticks are placed in a feed chute and a feed mechanism delivers the solid ink to a heater assembly. Solid ink sticks are either gravity fed or urged by a spring through the feed chute toward a heater plate in the heater assembly. The heater plate melts the solid ink impinging on the plate into a liquid that is delivered to a print head for jetting onto a recording medium. U.S. Pat. No. 5,734,402 for a Solid Ink Feed System, issued Mar. 31, 1998 to Rousseau et al. and U.S. Pat. No. 5,861,903 for an Ink Feed System, issued Jan. 19, 1999 to Crawford et al. describe exemplary systems for delivering solid ink sticks into a phase change ink printer.

In known printing systems having an intermediate imaging member, such as ink printing systems, the print process includes an imaging phase, and a transfer phase. In ink printing systems, the imaging phase is the portion of the print process in which the ink is expelled through the piezoelectric elements comprising the print head in an image pattern onto the imaging drum or other intermediate imaging member. The transfer or transfix phase is the portion of the print process in which the ink image on the imaging drum is transferred to the recording medium.

In printers with an imaging member in the form of a rotatable drum, a release agent is often applied to the imaging member before the ink or other marking material that forms the image is transferred to the imaging member. The release agent is typically an oil or similar material such as a silicone fluid that facilitates release of the ink drops or other marking material from the imaging drum and on to the recording medium.

With reference now to FIG. 6 an exemplary embodiment of a presently known release agent application system is shown. In this embodiment, the release agent is deposited on to the imaging drum 200 by a counter-rotating oiling roller 202 before the image is laid down by the print head. The oiling roller 202 dips into a reservoir 204 of release agent and transfers the release agent to the rotating imaging drum 200. Once the release agent is deposited onto the imaging drum 200, the thickness of the release agent on the imaging drum is controlled by a flexible metering blade 206. The flexible metering blade 206 is designed to scrape excess oil away from the imaging drum 200 as it passes the metering blade 206. Thereafter, a print head applies an image to the metering drum on top of the release agent. Once the image is properly printed on the drum 200, the transfix process occurs between paper and in a high pressure nip formed by a transfix roller (not shown in FIG. 6) and the imaging drum 200. However, if too much release agent is metered onto the imaging drum 200, the excess release agent may be transferred to the print media, and the print media may contaminate the transfix roller.

The presence of release agent on the transfix roller typically does not affect printing for one-sided images, as the release agent is only on the side of the media sheet to which no image was transferred. However, in duplex or two-sided printing, the presence of release agent may degrade the quality of the image. This degrading occurs because the release agent on the back side of the media sheet affects the transfer of ink from the imaging member to the media sheet. Consequently, the deposition of a proper amount of release agent on the imaging member is important for good image transfer, particularly in duplex printing operations.

With current arrangements utilizing a metering blade to control the thickness of the release agent on the imaging drum, more release agent is deposited on the drum as the speed of the drum increases. One way to address this is to keep the drum speed low, but this may also lower productivity. Another issue arising from the use of known metering blade arrangements is that the metering blades wear over time, causing excess release agent to remain on the imaging drum or causing an uneven layer of release agent on the imaging drum.

In view of the foregoing, it would be desirable to provide a printer drum maintenance system capable of controlling the thickness of the release agent on the imaging drum without lowering the productivity of the printer. It would also be desirable to provide a printer drum maintenance system capable of applying a consistent and even layer of release agent on the imaging drum even after extended periods of use of the printer.

SUMMARY

In order to address the foregoing issues a new method and apparatus have been developed for metering release agent on the imaging member. In at least one embodiment, the method for metering a release agent comprises applying a release agent to a rotating imaging member at an application location and then controlling a thickness of the release agent on the imaging member with a rotating metering roll. The rotating metering roll is positioned apart from the application location for the release agent. A rotating applicator roll is used to apply the release agent to the rotating imaging member at the application location.

In at least one embodiment, the method for metering a release agent further comprises rotating the metering roll as a counter-roll to the imaging drum such that the metering roll moves in an opposite direction from the imaging drum at a nip between the metering roll and the imaging drum. The metering roll may further include an elastomer provided over the substantial portion of its outer surface which contacts the imaging drum. The metering roll may also be forcibly biased against the imaging member. The method may further comprise removing release agent from the metering roll with at least one wiper blade provided in contact with the metering roll. Furthermore, the thickness of the release agent on the imaging drum may be controlled by controlling the rotational speed of the metering roll.

Similarly, in at least one embodiment, an apparatus for metering release agent on a rotatable imaging member comprises a release agent applicator and a rotatable metering roll. The release agent applicator is configured to apply a release agent to the rotatable imaging member at an application location. The rotatable metering roll is configured to control a thickness of the release agent on the imaging member at a location removed from the application location.

In at least one embodiment of the apparatus for metering release agent on a rotatable imaging member, the metering roll is configured to engage the imaging member at a nip. Furthermore, the metering roll may be configured to rotate in the same rotational direction as the imaging member such that the metering roll and the imaging member move in opposite tangential directions at the nip. In addition, the metering roll may be forcibly biased against the imaging drum. The metering roll may include an outer surface comprised of an elastomer. At least one wiper may be provided in contact with the metering roll in order to remove release agent from the metering roll.

In at least one embodiment of the apparatus for metering release agent on a rotatable imaging member, the release agent applicator comprises an applicator roll in engagement with a release agent reservoir. The metering roll may be configured to rotate at a plurality of different rotational speeds such that the thickness of the release agent on the imaging member is controllable based at least in part on the rotational speed of the metering roll.

The above described features and advantages, as well as others, will become more readily apparent to those of ordinary skill in the art by reference to the following detailed description and accompanying drawings. While it would be desirable to provide a method and system for applying a release agent to an imaging member that provides one or more of these or other advantageous features as may be apparent to those reviewing this disclosure, the teachings disclosed herein extend to those embodiments which fall within the scope of the appended claims, regardless of whether they include or accomplish one or more of the advantages or features mentioned herein.

BRIEF DESCRIPTION OF THE DRAWINGS

The foregoing aspects and other features of a method and apparatus for applying a release agent to an imaging member are explained in the following description, taken in connection with the accompanying drawings, wherein.

DETAILED DESCRIPTION

Figure 1:
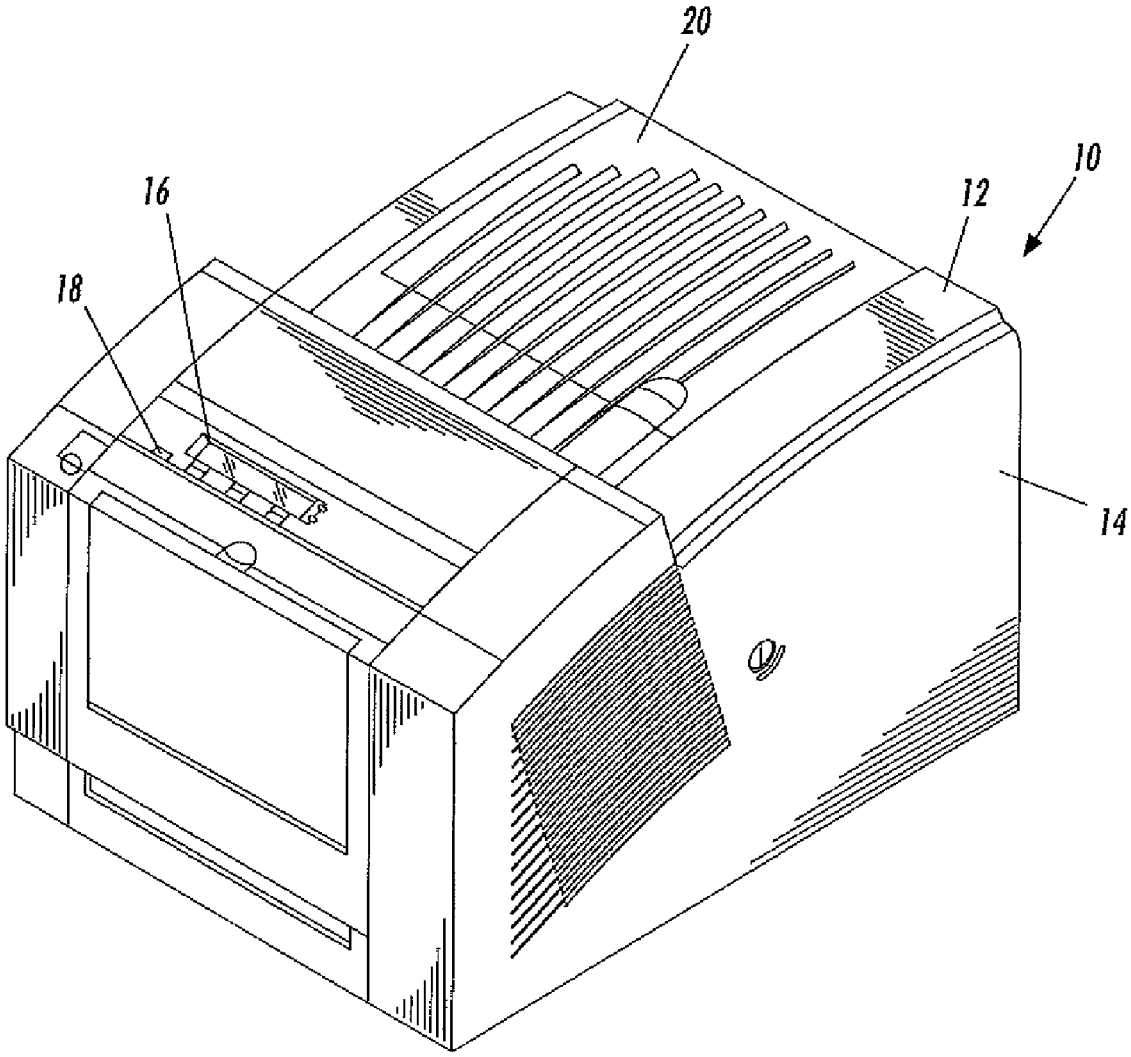
FIG. 1 is a side view of an exemplary ink printer configured for operation with a release agent metering system.

Referring to FIG. 1, there is shown a perspective view of an ink printer 10 that implements a single direction print process that preserves duplex printing capability. The reader should understand that the embodiment discussed herein may be implemented in many alternate forms and variations. In addition, any suitable size, shape or type of elements or materials may be used. Furthermore, the word "printer", "printing device" or "printing system" as used herein encompasses any apparatus, such as a digital copier, bookmaking machine, facsimile machine, multi-function machine, etc. which performs a print outputting function for any purpose. The term "marking material" as used herein encompasses any colorant or other material used to mark on paper or other print media. Examples of marking material include inks, toner particles, pigments, and dyes.

FIG. 1 shows an ink printer 10 that includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer. An ink jet printing mechanism (not shown) is contained inside the housing. An ink feed system delivers ink to the printing mechanism. The ink feed system is contained under the top surface of the printer housing. The top surface of the housing includes a hinged ink access cover 20 that opens as shown in FIG. 2, to provide the user access to the ink feed system.

Figure 2:
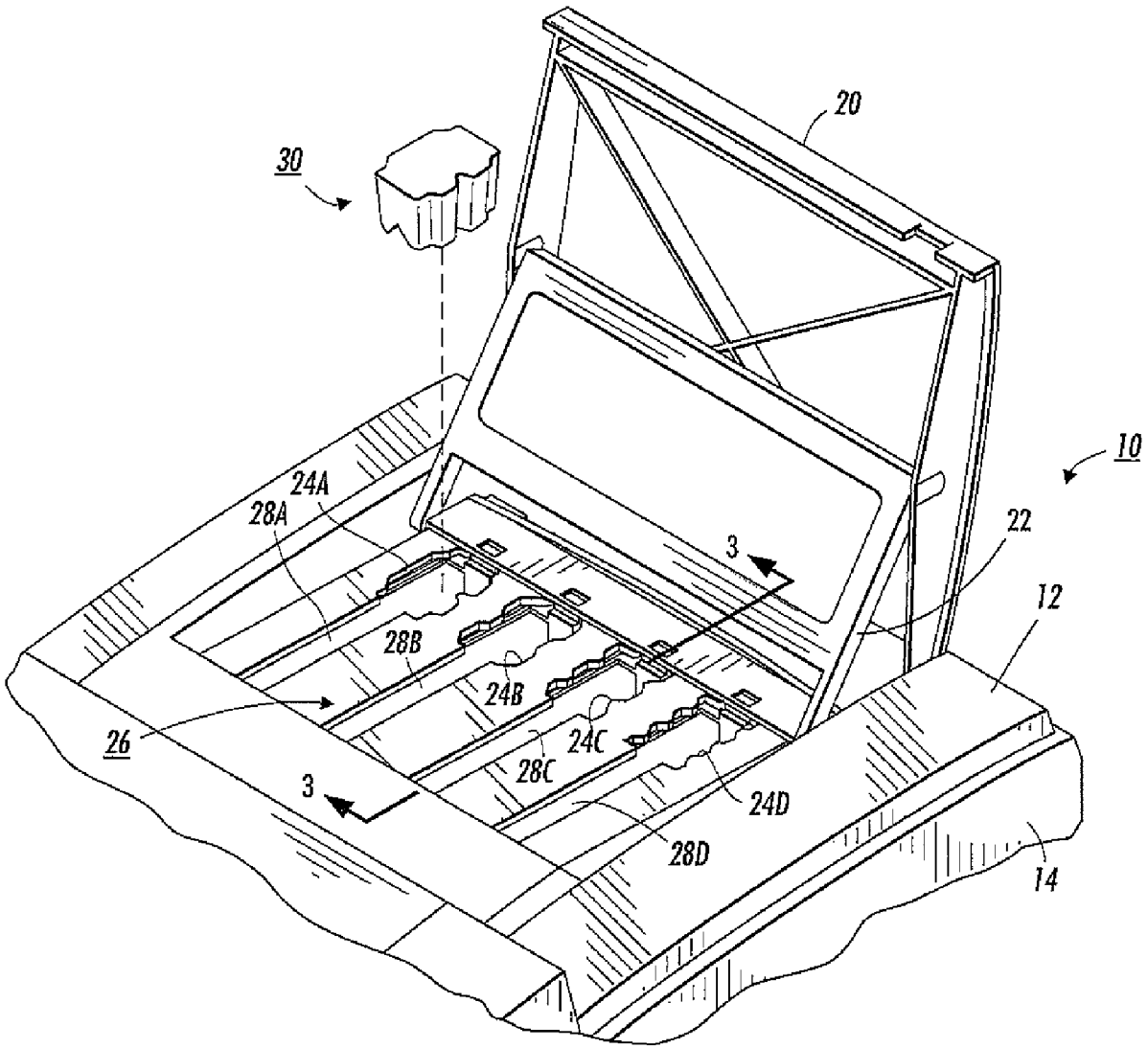
FIG. 2 is an enlarged partial top perspective view of the ink printer of FIG. 1 with the ink access cover open, showing a solid ink stick in position to be loaded into a feed channel.

In the particular printer shown in FIG. 2, the ink access cover 20 is attached to an ink load linkage element 22 so that when the printer ink access cover 20 is raised, the ink load linkage 22 slides and pivots to an ink load position. The ink access cover and the ink load linkage element may operate as described in U.S. Pat. No. 5,861,903 for an Ink Feed System, issued Jan. 19, 1999 to Crawford et al. As seen in FIG. 2, opening the ink access cover reveals a key plate 26 having keyed openings 24A-D. Each keyed opening 24A, 24B, 240, 24D provides access to an insertion end of one of several individual feed channels 28A, 28B, 28C, 28D of the solid ink feed system.

A color printer typically uses four colors of ink (yellow, cyan, magenta, and black). Ink sticks 30 of each color are delivered through a corresponding individual one of the feed channels 28A-D. The operator of the printer exercises care to avoid inserting ink sticks of one color into a feed channel for a different color. Ink sticks may be so saturated with color dye that it may be difficult for a printer user to tell by color alone which color is which. Cyan, magenta, and black ink sticks in particular can be difficult to distinguish visually based on color appearance. The key plate 26 has keyed openings 24A, 24B, 240, 24D to aid the printer user in ensuring that only ink sticks of the proper color are inserted into each feed channel. Each keyed opening 24A, 24B, 240, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 3:
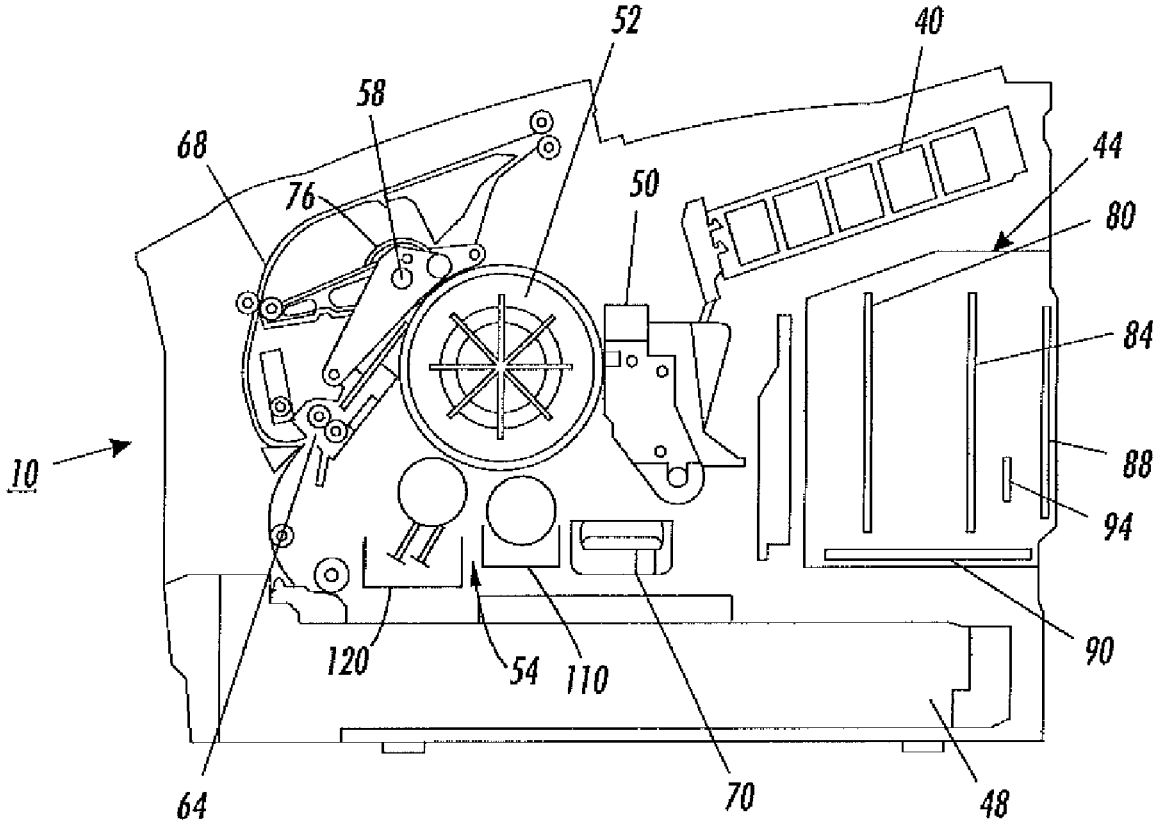
FIG. 3 is a side view of the ink printer shown in FIG. 2 depicting the major subsystems of the ink printer including a drum maintenance system for applying a release agent to an imaging member.

As shown in FIG. 3, the ink printer 10 may include an ink loading subsystem 40, an electronics module 44, a paper/media tray 48, a print head 50 having a plurality of ink jets, a rotatable drum 52 (also referred to herein as an "imaging member") which provides an intermediate imaging surface, a drum maintenance subsystem 54, a transfer subsystem 58, a paper/media preheater 64, a duplex print path 68, and an ink waste tray 70. In brief, solid ink sticks 30 are loaded into ink loader 40 through which they travel to a melt plate (not shown). At the melt plate, the ink stick is melted and the liquid ink is diverted to a reservoir in the print head 50. The print head includes a plurality of ink jets. The ink is ejected by piezoelectric elements through apertures in chemically etched stainless plates to form an image on the intermediate imaging member 52 as the member rotates. An intermediate imaging member heater is controlled by a controller to maintain the imaging member within an optimal temperature range for generating an ink image and transferring it to a sheet of print media. A sheet of print media is removed from the paper/media tray 48 and directed into the paper pre-heater 64 so the sheet of print media is heated to a more optimal temperature for receiving the ink image. A synchronizer delivers the sheet of the print media so its movement between the transfer roller in the transfer subsystem 58 and the intermediate image member 52 is coordinated for the transfer of the image from the imaging member to the sheet of print media.

The operations of the ink printer 10 are controlled by the electronics module 44. The electronics module 44 includes a power supply 80, a main board 84 with a controller, memory, and interface components (not shown), a hard drive 88, a power control board 90, and a configuration card 94. The power supply 80 generates various power levels for the various components and subsystems of the ink printer 10. The power control board 90 regulates these power levels. The configuration card contains data in nonvolatile memory that defines the various operating parameters and configurations for the components and subsystems of the ink printer 10. The hard drive stores data used for operating the ink printer and software modules that may be loaded and executed in the memory on the main card 84. The main board 84 includes the controller that operates the ink printer 10 in accordance with the operating program executing in the memory of the main board 84. The controller receives signals from the various components and subsystems of the ink printer 10 through interface components on the main board 84. The controller also generates control signals that are delivered to the components and subsystems through the interface components. These control signals, for example, drive the piezoelectric elements to expel ink through the apertures in the chemically etched print plates to form the image on the imaging member 52 as the member rotates past the print head.

As mentioned previously, it is advantageous to control the thickness of the release agent on the imaging drum. This is especially true for when printing a duplex image. A duplex image includes a first image that is transferred from the intermediate imaging member onto a first side of a print media sheet followed by a second image that is transferred from the intermediate imaging member onto the reverse side of the print media sheet to which the first image was transferred. One problem that occurs in printing systems that apply a release agent to the intermediate imaging member is the contamination of the reverse side of a print media sheet with release agent during the transfer of the first image onto the sheet. This contamination may then generate defects during the transfer of the second image on the reverse side of the print media sheet.

The drum maintenance system 54 of FIG. 3 includes a release agent metering device 120 that is configured to control the thickness of the release agent transferred to the imaging drum 52. One embodiment of the drum maintenance system 54 with release agent metering device is shown in further detail in FIG. 4.

Figure 4:
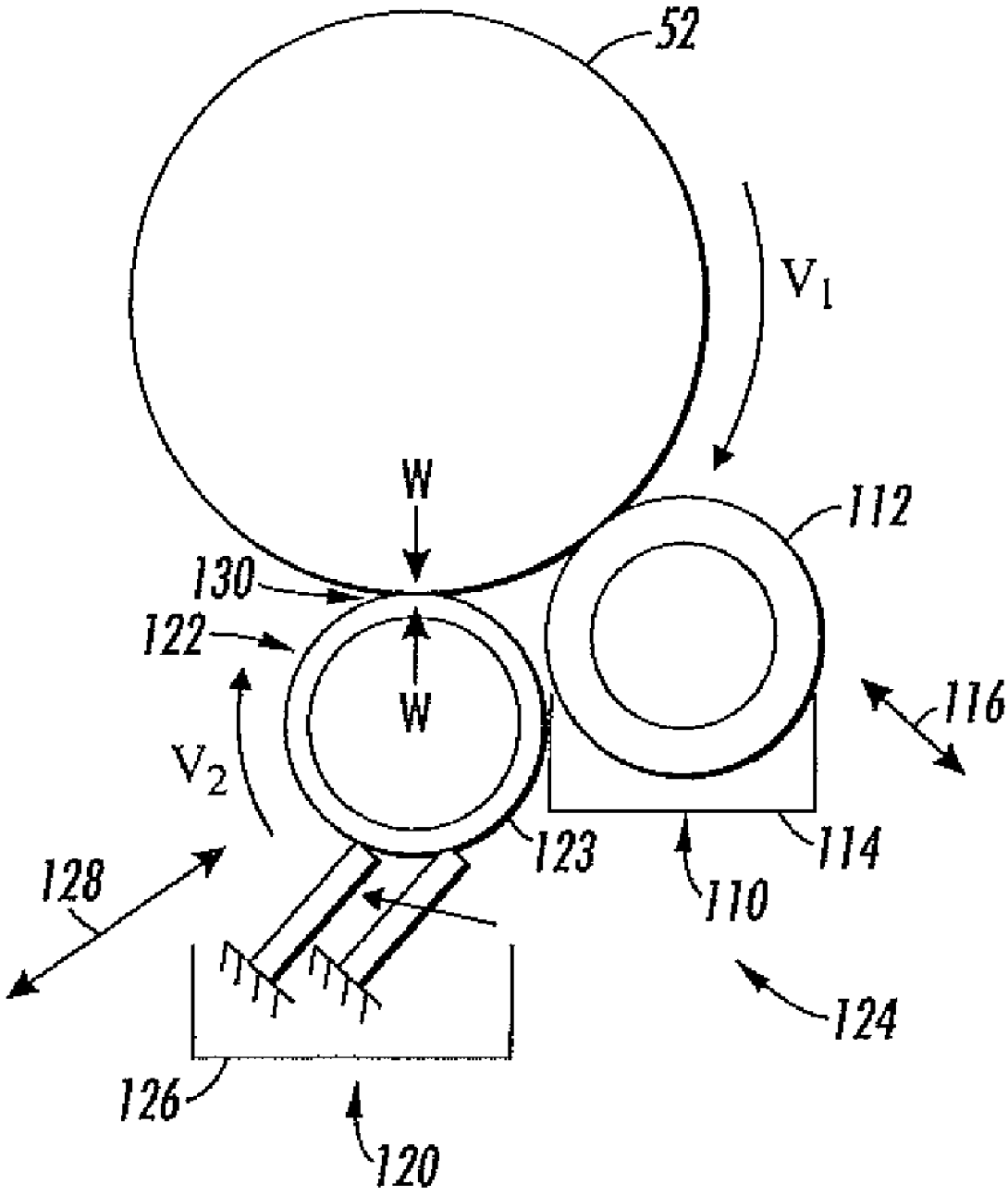
FIG. 4 is a cross-sectional side view of the drum maintenance system of FIG. 3.

With reference now to FIG. 4, the drum maintenance system 54 includes a release agent application system 110 and a release agent metering system 120. The release agent application system 110 includes an application roller 112 and a release agent reservoir 114. The application roller 112 is cylindrical in shape and extends for substantially the same length as the imaging drum 52. The application roller 112 is partially submerged in release agent held within the reservoir 114. The application roller 112 is driven by an electric motor (not shown) whose operation is controlled by the controller on the main board 84. As indicated by arrow 116, the application roller 112 and reservoir 114 are moveable between a forward position (as shown in FIG. 4) where the application drum 112 is in close proximity to or in contact with the imaging drum 52 and a removed position (not shown) where the application drum is distanced from the imaging drum. When the application roller 112 is in the forward position, the application roller may be rotated by an electric motor such that release agent from the reservoir 114 is carried from the application roller 112 and applied to the imaging drum 52. An exemplary arrangement for facilitating movement of the application roller 112 between different positions is disclosed in US Patent Application Publication No. 2007/0139496, the contents of which are incorporated herein by reference in their entirety.

Effective release agents include, for example, silicone fluids comprised of a blend of an organo-functional silicone oil and a non-functional silicone diluent. The concentrated organo-functional portion reacts with the imaging drum surface coating to improve oil uniformity while the diluent helps determine the overall release agent viscosity. In one embodiment, an amine functional silicone fluid is used that is comprised of approximately 0.025-0.15 mol % amine and a viscosity of 10-100 cP. In some applications, lower amine levels, such as, 0.025-0.075 mol % amine, and viscosities of 10-30 cP may enhance transferring performance. In one embodiment, a release agent viscosity that is less than 70 cP is used to minimize oil bar size on the intermediate imaging member as discussed in more detail below.

With continued reference to FIG. 4, the release agent metering system 120 includes a metering roll 122, wiper blades 124, and a release agent drip pan 126. The metering roll 122 is also cylindrical in shape and extends substantially the same length as the imaging drum 52. The metering roll 122 includes an outer surface 123 comprised of a soft resilient rubber material, such as an elastomer. The metering roll 122 is driven by an electric motor (not shown) which is controlled by the controller on the main board 84. As indicated by arrow 128, the metering roll 122 is also moveable between a forward position (shown in FIG. 4) wherein the metering roll 122 is in contact with the imaging drum 52 and a removed position (not shown) wherein the metering roll is distanced from the imaging drum.

When the metering roll 122 is in the forward position, the metering roll is in contact with the imaging drum 52. A nip 130 is formed at the line of contact between the imaging drum 52 and the metering roll 122. The metering roll 122 is configured to rotate as a "counter" or "reverse" metering roll. Accordingly, the electric motor is configured to rotate the metering roll 122 in the same rotational direction as the imaging drum 52. This means that at the nip 130 where the imaging drum 52 contacts the metering roll 122, the imaging drum 52 and the metering roll 122 are moving in different tangential directions such that the metering roll 122 is "counter" or "reverse" to the imaging drum 52. As shown in FIG. 4, the imaging drum 52 rotates at a velocity $V_1$ and the metering drum rotates at a velocity $V_2$.

In addition to the above, when the metering roll 122 is in the forward position, the metering roll 122 is forcibly biased against the imaging drum 52. As shown in FIG. 4, a load W is provided by the force of the metering roll 122 against the imaging drum 52.

Wiper blades 124 are provided in contact with the metering roll 122. The wiper blades 124 include a first and second wiper blade that are forcibly biased against the metering roll 122. The wiper blades may be comprised of any of numerous materials. For example, in at least one embodiment, the wiper blades 124 are comprised of a relatively rigid polymer material, such as a PVC. In an alternative embodiment, the wiper blades 124 are comprised of a soft resilient rubber material, such as an elastomer. The drip tray 126 is positioned below the wiper blades such that release agent wiped from the metering roll 122 with the wiper blades will drip into the drip tray. In at least one embodiment, the drip tray 126 may be connected to the release agent reservoir 114 such that excess release agent is automatically recycled for re-use in the printing machine.

In operation, the application roller 112 delivers a relatively thick layer of release agent to the imaging drum 52. The metering roll 122 then controls the thickness of the release agent on the imaging drum 52. In particular, as the metering roll 122 rotates against the imaging drum 52, excess release agent is wiped away from the imaging drum 52 and onto the metering roll 122, leaving a consistent and smooth layer of release agent on the imaging drum 52. As the metering roll 122 is rotated to the wipers 124, excess release agent is scraped from the metering roll 122 and drips down into the drip pan 126. The electric motor that drives the metering roll 122 may be controlled by the controller on the main board 84 to rotate at different rotational speeds. As explained in further detail below, if a thinner film on the imaging drum 52 is desired, the velocity of the metering roll 122 is driven closer to the velocity of the imaging drum 52. In at least one embodiment, the metering roll 122 is driven to substantially the same speed as that of the imaging drum 52 in order to achieve a consistent thin layer of release agent on the imaging drum. If a thicker film is required on the imaging drum, the velocity of the metering roll 122 is reduced such that it is substantially less than the velocity of the imaging drum 52.

With continued reference to FIG. 4, the thickness of the release agent on the imaging drum 52 is controlled at least in part by the velocities of the imaging drum 52 (V1) and the metering roll 122 (V2), as well as the load W between the imaging drum 52 and metering roll 122. The generic configuration of two elastic rolls with a fluid film as shown in FIG. 4 was modeled for a film thickness h vs. load W and speeds, V1 and V2. In this model, the film thickness metered onto the imaging drum is approximately ½ of the film thickness, h. A solution was obtained by coupling the approximate solution of the plane strain elasticity problem for the elastic rolls together with the Reynold's (lubrication) approximation for the fluid film. The fluid is assumed to fill the incoming side of the metering nip (a fully flooded inlet). The results show that a deformable reverse roll in contact with the imaging drum is a very effective way to control the oil film thickness on smooth rolls. In particular, as the magnitude of the reverse roll velocity approaches the imaging drum velocity, the film thickness on the smooth portions of the imaging drum approach zero. In the model, the approximate solution breaks down if the magnitude of the reverse roll velocity exceeds that of the imaging drum. In such a case, the pressure in the film becomes negative and cavitation may occur.

While FIGS. 1-4 show one exemplary embodiment of an ink printer configured for operation with a release agent metering system, it will be recognized by those in the art that the release agent metering system of FIG. 4 may be configured for use with other ink printers. An example of such an alternative embodiment is shown in FIG. 5 where a direct-to-sheet, continuous-web, phase-change ink printer is shown.

Figure 5:
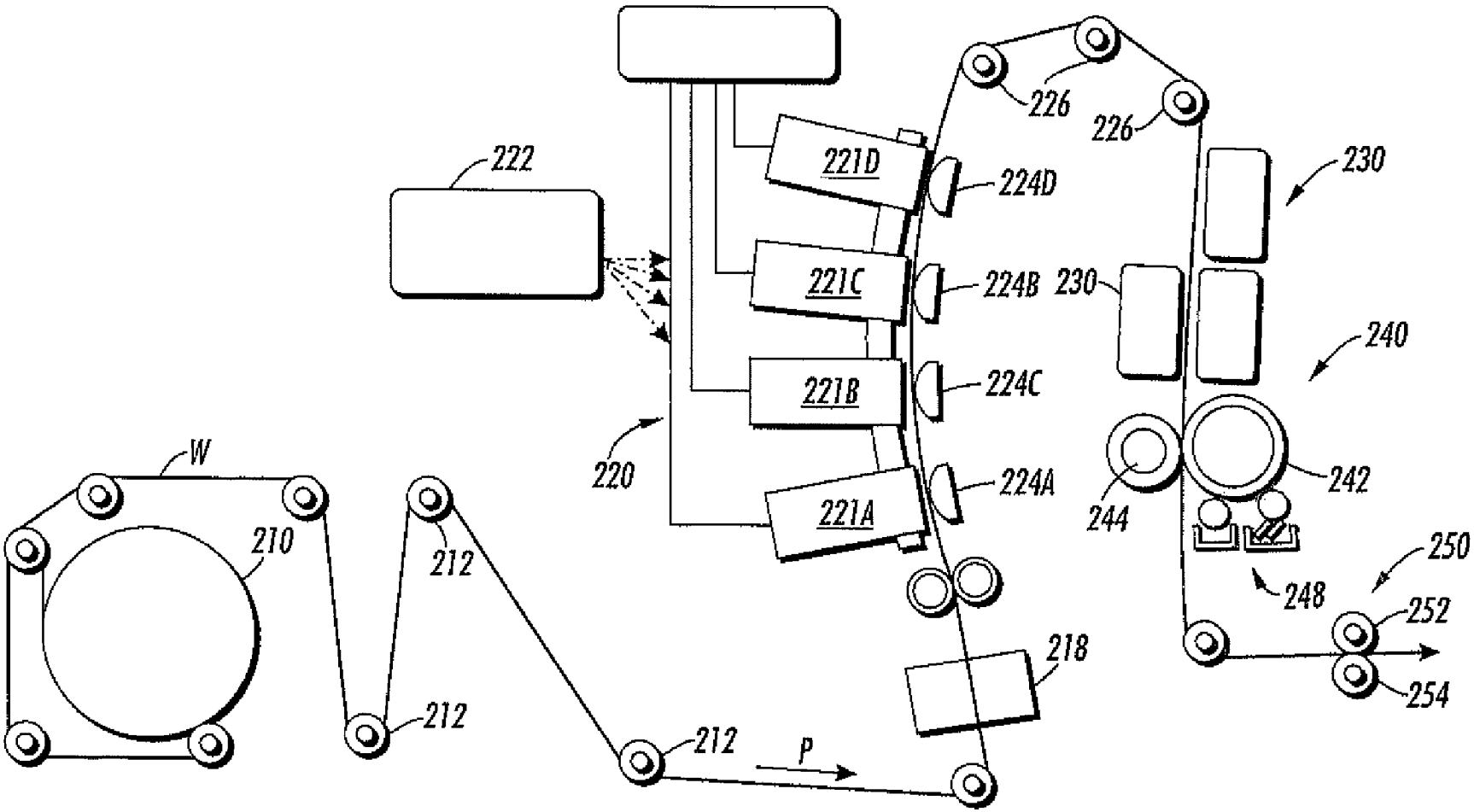
FIG. 5 shows an alternative embodiment of an exemplary ink printer configured for operation with the release agent metering system of FIG. 4.
Figure 6:
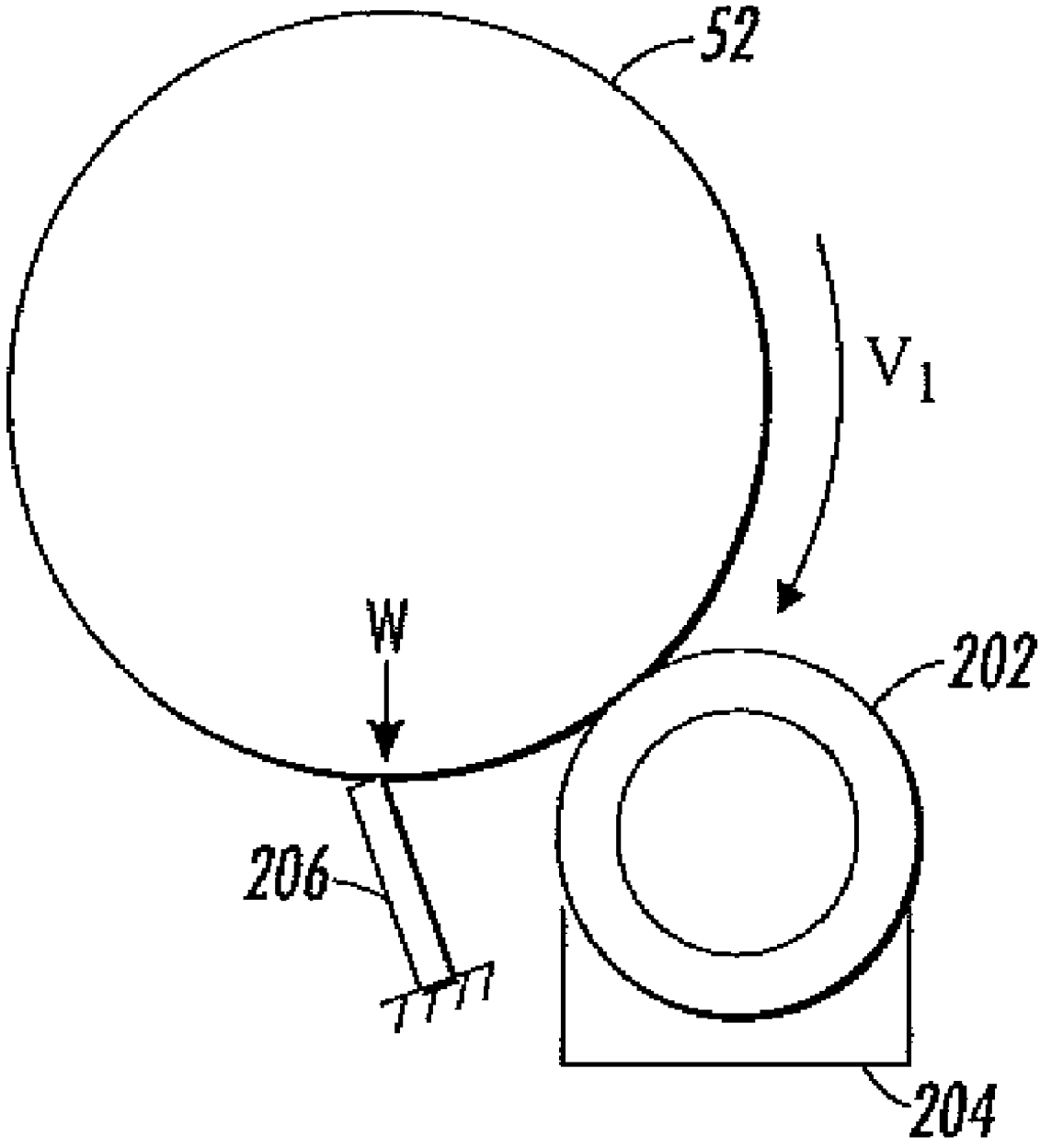
FIG. 6 PRIOR ART
FIG. 6 is a cross-sectional side view of a prior art drum maintenance system.

In the printer of FIG. 5, a very long (i.e., substantially continuous) imaging surface is provided as a web W of "substrate" (paper, plastic, or other printable material), supplied on a spool 210. The web W is propelled by a variety of motors, not shown through the ink printer. A set of rolls 212 controls the tension of the unwinding web as the web moves through a path. Along the path there is provided a preheater 218, which brings the web to an initial predetermined temperature. The web W moves through a printing station 220 including a series of printheads 221A, 221B, 221C, and 221D, each printhead effectively extending across the width of the web and being able to eject ink of one primary color directly onto the moving web. As is generally familiar, each of the four primary-color images placed on overlapping areas on the web W combine to form a full-color image, based on the image data sent to each printhead through image path 222. Associated with each primary color printhead is a backing member 224A, 224B, 224C, 224D, typically in the form of a bar or roll, which is arranged substantially opposite the printhead on the other side of web W. Following the printing zone 220 along the web path is a series of tension rolls 226, followed by one or more "midheaters" 230.

Following the midheaters 230, along the path of web W, is a "spreader" 240, that applies a predetermined pressure, and in some implementations, heat, to the web W. The function of the spreader 240 is to take what are essentially isolated droplets of ink on web W and smear them out to make a continuous layer by pressure, and, in one embodiment, heat, so that spaces between adjacent drops are filled and image solids become uniform. In addition to spreading the ink, the spreader 240 may also improve image permanence by increasing ink layer cohesion and/or increasing the ink-web adhesion. The spreader 240 includes rolls, such as image-side rotatable drum 242 and pressure roll 244, that apply heat and pressure to the web W. A cleaning/oiling station 248 is also provided at the spreader 240.

In the embodiment of FIG. 5, the cleaning/oiling station 248 is provided as the release agent metering station shown in FIG. 4, as described above. In this system, the release agent metering station cams in to the image spreader drum surface 242 at the beginning of a print run and cams away from the drum 242 after the run has completed, continually maintaining the surface during the print run. This is in contrast to the embodiment of FIGS. 1-4 where the release agent metering station cams in to the rotatable imaging drum for each cleaning cycle, and cams away from the rotatable imaging drum at the completion of the maintenance cycle (i.e., once for each drum imaging cycle).

Following the spreader 240 in the embodiment of FIG. 5, the printer in this embodiment includes a "glosser" 250, whose function is to change the gloss of the image. The glosser 250 includes two rolls (image-side roll 252 and pressure roll 254) forming a nip through which the web W passes.

Those skilled in the art will recognize that numerous modifications can be made to the specific implementations described above. Those skilled in the art will recognize that the single direction print process and release agent control may be adapted for other printers than those described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printing apparatus comprising:

an imaging surface provided on a rotatable drum;

a print head having a plurality of ink jets, the print head configured to eject ink on to the imaging surface;

a release agent applicator including an applicator roll configured to apply a release agent to the imaging surface of the rotatable drum; and a rotatable metering roll configured to form a nip with the rotatable drum and carry release agent from the imaging surface and out of the nip to a position where removed release agent is removed from the rotatable metering roll to control a thickness of the release agent on the imaging surface of the rotatable drum.

2. The apparatus of claim 1 wherein the metering roll is configured to rotate in the same rotational direction as the rotatable drum to enable the metering roll and the rotatable drum to move in opposite tangential directions at the nip.

3. The apparatus of claim 1 wherein the metering roll is forcibly biased against the rotatable drum.

4. The apparatus of claim 1 wherein the applicator roll receives release agent from a release agent reservoir.

5. The apparatus of claim 1, the metering roll further comprising:

an elastomer covering an outer surface of the metering roll.

6. The apparatus of claim 1 further comprising:

at least one wiper configured to contact the metering roll at the position where the removed release agent is removed from the metering roll and to scrape release agent from the metering roll.

7. The apparatus of claim 1 wherein the metering roll is configured to rotate at a plurality of different rotational speeds to enable the thickness of the release agent on the rotatable drum to be controlled with reference to a rotational speed of the metering roll.

8. The apparatus of claim 1 wherein the release agent applicator is configured to provide the release agent to the imaging surface before the print head ejects ink on to the imaging surface.

9. A printing apparatus comprising:

a rotatable imaging member;

a rotatable release agent applicator configured to apply a release agent to the rotatable imaging member;

a rotatable metering roll configured to engage the imaging member at a nip and carry release agent removed from the imaging member away from the nip, the metering roll and the imaging member are also configured to rotate in the same rotational direction to enable the metering roll and the imaging member to move in opposite directions at the nip;

a wiper configured to remove from the metering roll release agent carried by the metering roll from the nip; and a print head having a plurality of ink jets, the print head configured to apply ink to the rotatable imaging member.

10. A method for operating a printing apparatus, the method comprising:

applying a release agent to a rotating drum at an application location;

engaging the rotating drum with a rotating metering roll to remove release agent from the rotating drum and carry the removed released agent away from the rotating drum;

removing release agent from the metering roll after the metering roll has carried the removed release agent away from the rotating drum to control a thickness of the release agent on the rotating drum with the rotating metering roll, the rotating metering roll being positioned apart from the application location; and applying ink to a moving imaging surface that contacts the rotating drum using a print head having a plurality of ink jets.

11. The method of claim 10 wherein a rotating applicator roll is used to apply the release agent to the rotating drum.

12. The method of claim 10 wherein the metering roll rotates in the same rotational direction as the rotating drum.

13. The method of claim 10 wherein the rotating metering roll includes an elastomer provided over the substantial portion of an outer surface of the metering roll.

14. The method of claim 10 wherein the metering roll is in contact with the rotating drum.

15. The method of claim 14 wherein the metering roll is forcibly biased against the rotating drum.

16. The method of claim 14 wherein the metering roll is provided as a counter roll to the rotating drum to enable the metering roll and the imaging member to move in opposite directions at a nip between the metering roll and the imaging member.

17. The method of claim 10 wherein the moving imaging surface is provided as an outer surface of the rotating drum and the release agent is applied to the moving imaging surface before the ink is applied to the moving imaging surface.

18. The method of claim 10 wherein release agent is removed from the metering roll by wiping the metering roll with at least one wiper blade.

19. The method of claim 10 further comprising controlling the rotational speed of the metering roll to control the thickness of the release agent on the rotating drum.

* * * * *